US011174739B2

(12) United States Patent
Duong et al.

(10) Patent No.: US 11,174,739 B2
(45) Date of Patent: Nov. 16, 2021

(54) DAMPED TURBINE BLADE ASSEMBLY

(71) Applicant: Solar Turbines Incorporated, San Diego, CA (US)

(72) Inventors: Loc Quang Duong, San Diego, CA (US); Olivier Jacques Lamicq, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 150 days.

(21) Appl. No.: 16/552,853

(22) Filed: Aug. 27, 2019

(65) Prior Publication Data

US 2021/0062659 A1 Mar. 4, 2021

(51) Int. Cl.
*F01D 5/22* (2006.01)
*F01D 5/26* (2006.01)

(52) U.S. Cl.
CPC ..... *F01D 5/225* (2013.01); *F01D 5/22* (2013.01); *F01D 5/26* (2013.01); *F05D 2220/32* (2013.01)

(58) Field of Classification Search
CPC ..... F01D 5/225; F01D 5/26; F05D 2220/32
USPC ..... 416/223 R
See application file for complete search history.

(56) References Cited

U.S. PATENT DOCUMENTS 6,371,727 B1 4/2002 Stangeland et al.
6,659,725 B2 12/2003 Yeo et al.
7,021,898 B2 4/2006 Elliott et al.
7,434,670 B2 10/2008 Good et al.
8,105,039 B1 1/2012 El-Aini
8,231,352 B2 7/2012 Hunt et al.
8,894,353 B2 11/2014 McCracken et al.
9,194,240 B2 * 11/2015 Blanchard ..... F01D 5/26
2010/0202888 A1 * 8/2010 Miller ..... F01D 5/225 416/190
2013/0101395 A1 * 4/2013 Miller ..... F01D 25/06 415/119
2015/0030443 A1 1/2015 Richardson et al.
2015/0345309 A1 * 12/2015 Davidson ..... F01D 5/3007 60/805

(Continued)

FOREIGN PATENT DOCUMENTS

CN 1877083 A 12/2006
EP 0806545 B1 12/1997
JP 2014114734 A * 6/2014

(Continued)

*Primary Examiner* — Mahmoud Gimie
(74) *Attorney, Agent, or Firm* — Procopio, Cory, Hargreaves & Savitch LLP; Jeff A. Greene

(57) ABSTRACT

A damped turbine blade assembly for a gas turbine engine is disclosed. The damped turbine blade assembly includes a damper positioned within a first small slot of a first turbine blade and a second large slot of the second turbine blade. A portion of the damper can slidably mate with the second large slot providing a radial and angular connection between the first turbine blade and second turbine blade while allowing movement in a direction tangent to a radial of a center axis of the gas turbine engine. The tangential movement is resisted by friction between the damper contacting the second large slot and provides friction damping against vibrations felt by the turbine blades during operation of the gas turbine engine. The damper can be shaped and/or pre-stressed to control the normal force component of the friction between the damper and the second large slot.

20 Claims, 6 Drawing Sheets

(56) References Cited

U.S. PATENT DOCUMENTS

2015/0345388 A1* 12/2015 Dimascio ..... B23K 1/0018
428/141

FOREIGN PATENT DOCUMENTS

| | | | |
|---|---|---|---|
| JP | 2015148284 | A | 8/2015 |
| WO | 2018175356 | A1 | 9/2018 |

* cited by examiner

DAMPED TURBINE BLADE ASSEMBLY

TECHNICAL FIELD

The present disclosure generally pertains to gas turbine engines. More particularly this application is directed toward a damped turbine blade assembly for a gas turbine engine.

BACKGROUND

Gas turbine engines commonly include an axial flow turbine that comprises at least one annular array of radially extending turbine blades mounted on a common disc. Each turbine blade is sometimes provided with a shroud at its radially outer tip so that the shrouds of adjacent blades cooperate to define a radially outer circumferential boundary to the gas flow over the turbine blades. In operation, there can be a tendency for the gas flows over the turbine blades to cause the blades to vibrate to such an extent that they require some degree of damping. Any vibration of the blades results in relative movement between their shrouds and hence between the passages.

U.S. Pat. No. 8,231,352 to Hunt et al., describes a vibration damper assembly for damping non-synchronous vibration between adjacent, spaced apart components. The vibration damper assembly comprises a vibration damper located in both of a pair of generally confronting passages in each of the components. The assembly comprises at least two spaced apart articulation surfaces for contact between damper and component, each of the articulation surfaces is arcuate in a first direction and is characterized by having a substantially linear portion in an orthogonal and second direction. Thereby the contact area is greatly enlarged and material loss minimized. The cross-sectional shape of the damper or passage is non-circular and there is a clearance between the damper and passage sufficiently small to prevent rotation of the damper in the passage during use.

The present disclosure is directed toward overcoming one or more of the problems discovered by the inventors.

SUMMARY

A damped turbine blade assembly for a gas turbine engine is disclosed herein. The damped turbine blade assembly comprising a first turbine blade and a damper. The first turbine blade including a base, an airfoil comprising a skin extending from the base, and an upper shroud located opposite from the base. The upper shroud including a first small slot. The first small slot having a first small slot top surface, a first small slot bottom surface located opposite of the first small slot top surface, and a first small slot side surface extending from the first small slot top surface to the first small slot bottom surface. The damper is configured to be positioned within the first small slot and simultaneously contact the first small slot top surface, the first small slot bottom surface, and the first small slot side surface.

BRIEF DESCRIPTION OF THE FIGURES

The details of embodiments of the present disclosure, both as to their structure and operation, may be gleaned in part by study of the accompanying drawings, in which like reference numerals refer to like parts, and in which:

FIG. 6 is a cross sectional view of the turbine blades of FIG. 5 along line VI-VI with an exemplary damper positioned in between;

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

Figure 1:
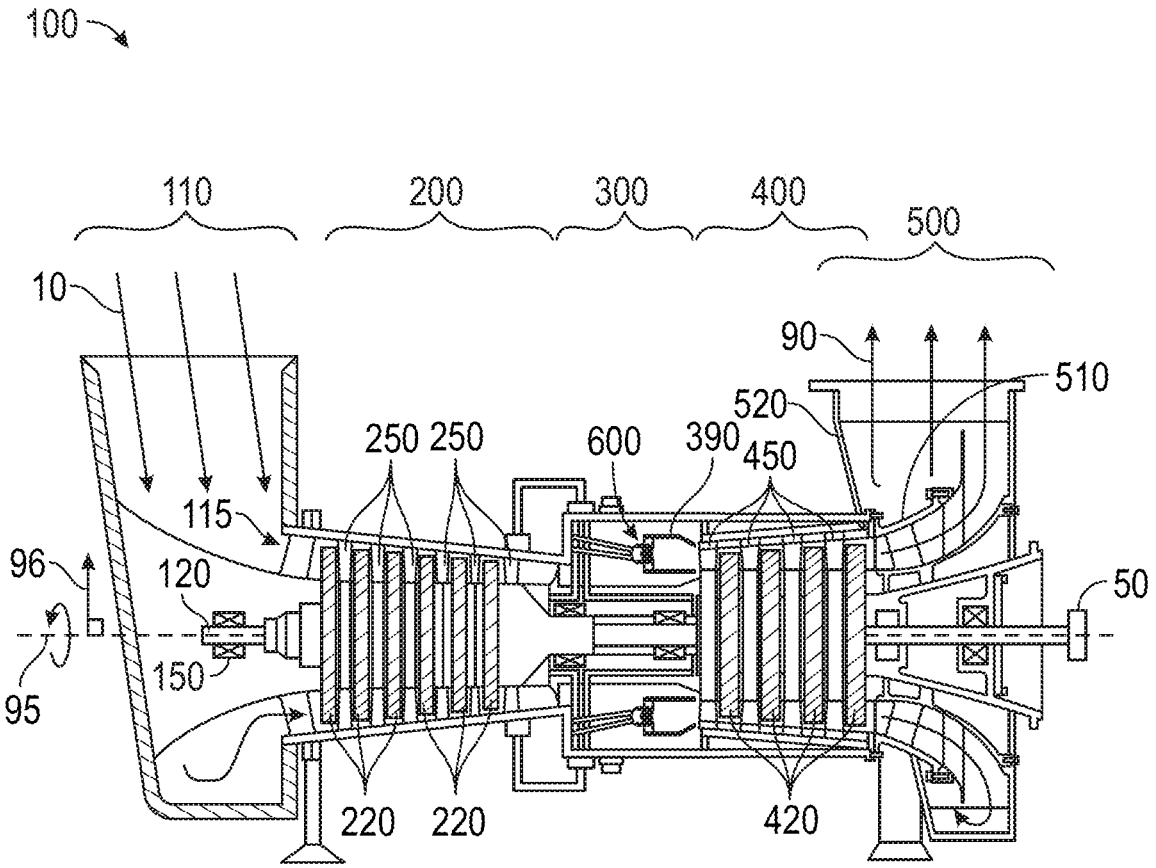
FIG. 1 is a schematic illustration of an exemplary gas turbine engine.

FIG. 1 is a schematic illustration of an exemplary gas turbine engine. Some of the surfaces have been left out or exaggerated for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a gas producer or compressor 200, a combustor 300, a turbine 400, an exhaust 500, and a power output coupling 50. The compressor 200 includes one or more compressor rotor assemblies 220. The combustor 300 includes one or more injectors 600 and includes one or more combustion chambers 390. The turbine 400 includes one or more turbine rotor assemblies 420. The exhaust 500 includes an exhaust diffuser 510 and an exhaust collector 520.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes 250 and 450 ("stator vanes" or "stators") circumferentially distributed in an annular casing.

A gas (typically air 10) enters the inlet 110 as a "working fluid", and is compressed by the compressor 200. In the compressor 200, the air 10 is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420. However, other numbering/naming conventions may also be used.

Once compressed air 10 leaves the compressor 200, it enters the combustor 300, where it is diffused and fuel is added. Air 10 and fuel are injected into the combustion chamber 390 via injector 600 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 510 and collected, redirected, and exit the system via an exhaust collector 520. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
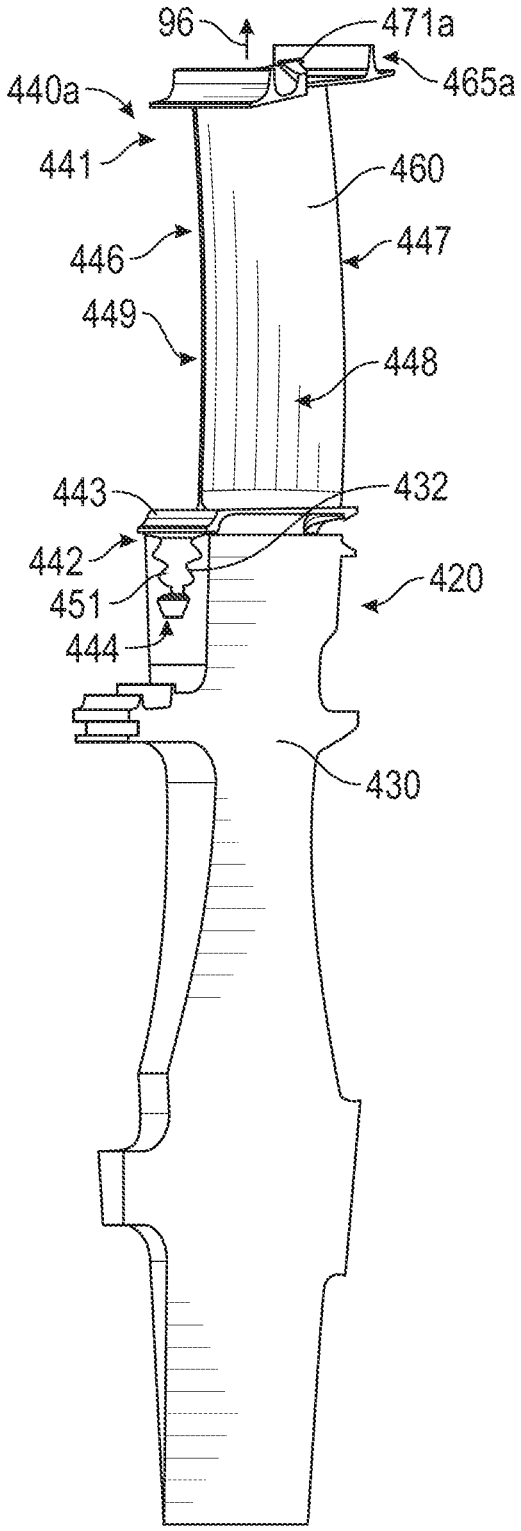
FIG. 2 is a cross sectional view of a portion of the exemplary turbine rotor assembly from FIG. 1.

FIG. 2 is a cross sectional view of a portion of the exemplary turbine rotor assembly from FIG. 1. In particular, a portion of the turbine rotor assembly 420 schematically illustrated in FIG. 1 is shown here in greater detail, but in isolation from the rest of gas turbine engine 100. The portion of the turbine rotor assembly 420 shown in FIG. 2 includes a portion or slice of a turbine rotor disk 430 cross sectioned on both sides corresponding approximately to the area under a first turbine blade 440*a*. The first turbine blade 440*a* may include a base 442 including a platform 443 and a blade root 451. For example, the blade root 451 may incorporate "fir tree", "bulb", or "dove tail" roots, to list a few. Correspondingly, the turbine rotor disk 430 may include a circumferentially distributed slot or blade attachment groove 432 configured to receive and retain the first turbine blade 440*a*. In particular, the blade attachment groove 432 may be configured to mate with the blade root 451, both having a reciprocal shape with each other. In addition the blade root 451 may be slidably engaged with the blade attachment groove 432, for example, in a forward-to-aft direction.

The first turbine blade 440*a* may further include an airfoil 441 extending radially outward from the platform 443 and away from the turbine rotor disk 430. The airfoil 441 may have a complex, geometry that varies radially. For example the cross section of the airfoil 441 may lengthen, thicken, twist, and/or change shape as it radially approaches the platform 443 inward from an upper shroud 465*a*. The overall shape of airfoil 441 may also vary from application to application.

The first turbine blade 440*a* is generally described herein with reference to its installation and operation. In particular, the first turbine blade 440*a* is described with reference to both a radial 96 of center axis 95 (FIG. 1) and the aerodynamic features of the airfoil 441. The aerodynamic features of the airfoil 441 include a leading edge 446, a trailing edge 447, a pressure side 448, and a lift side 449 (also referred to as suction side). As discussed above, airfoil 441 also extends radially between the platform 443 and the tip end upper shroud 465*a*. The upper shroud 465*a* may be located outward from the airfoil 441 and is disposed opposite from the root end 444. The upper shroud 465*a* can include an abutment 471*a* located on the side of the upper shroud 465*a*. The upper shroud 465*a* may be formed as part of each turbine blade 440*a* and may interface with the outward end of the airfoil 441. Thus, when describing the first turbine blade 440*a* as a unit, the inward direction is generally radially inward toward the center axis 95 (FIG. 1), with its associated end called a "root end" 444. Likewise the outward direction is generally radially outward from the center axis 95 (FIG. 1), with its associated end being defined by the shroud 465*a*.

In addition, when describing the airfoil 441, the forward and aft directions are generally measured between its leading edge 446 (forward) and its trailing edge 447 (aft) When describing the flow features of the airfoil 441, the inward and outward directions are generally measured in the radial direction relative to the center axis 95 (FIG. 1).

Finally, certain traditional aerodynamics terms may be used herein for clarity, but without being limiting. For example, while it will be discussed that the airfoil 441 (along with the entire first turbine blade 440*a*) may be made as a single metal casting, the outer surface of the airfoil 441 (along with its thickness) is descriptively called herein the "skin" 460 of the airfoil 441.

Figure 3:
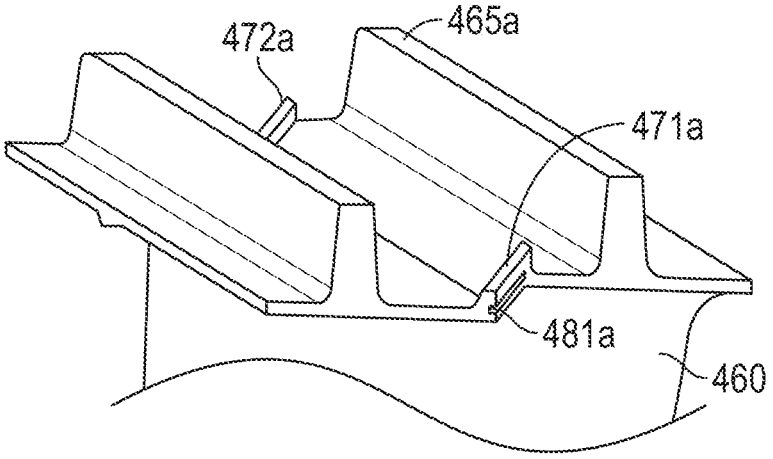
FIG. 3 is a perspective view of the first turbine blade from FIG. 2.

FIG. 3 is a perspective view of a first turbine blade from FIG. 2. In particular, this figure shows an abutment 471*a* that is located on the side of the upper shroud 465*a*. A second abutment 472*a* may be located opposite of abutment 471*a* such that there are abutments on both sides of the upper shroud 465*a*. The abutment 471*a* can be located proximate to the pressure side 448 and the abutment 472*a* can be located proximate to the lift side 449, sometimes referred to as the suction side. The description of abutment 471*a* can be applied to abutment 472*a* unless described otherwise. The abutment 471*a* may be at an angle relative to the center axis 95. The abutment 471*a* can have a mating surface configured to mate with the surface of an abutment of another turbine blade when positioned within the turbine rotor assembly 430. The abutment 471*a* can have a first small slot 481*a*, extending along a portion of the abutment 471*a*, through the mating surface and providing a void. The abutment 472*a* can have a first large slot (not shown) instead of a first small slot 481*a*. The first small slot 481*a* can extend through at least two of the surfaces of the abutment 471*a*. The first small slot 481*a* can have a rectangular or curved shape.

Figure 4:
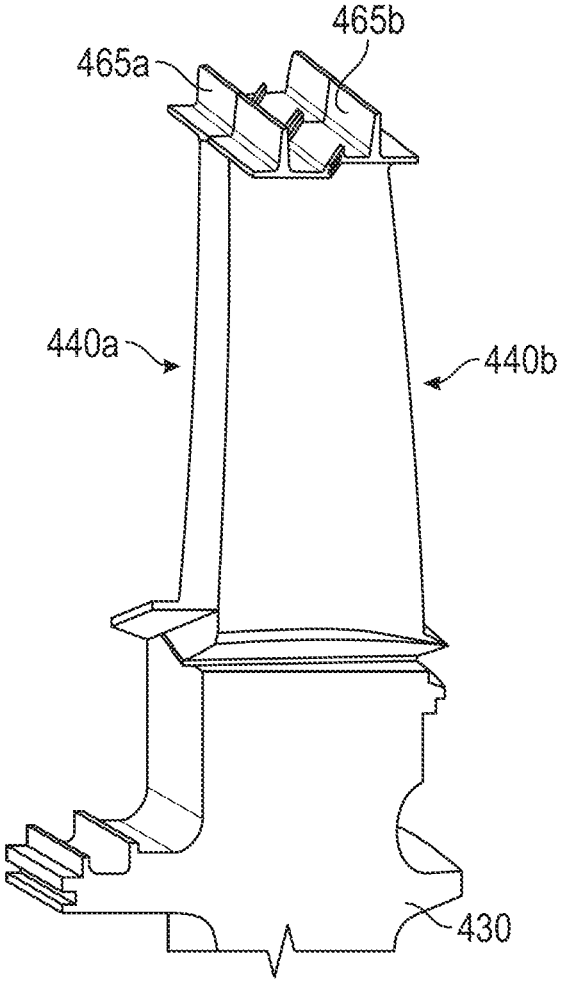
FIG. 4 is a perspective view of the first turbine blade from FIG. 2 with a second turbine blade.

FIG. 4 is a perspective view of the first turbine blade from FIG. 2 with a second turbine blade. In embodiments, a second turbine blade 440*b* may include the same or similar features as first turbine blade 440*a* shown in FIG. 2 and other figures. The turbine blades 440*a, b* and their sub-components can be referenced sequentially herein using letters and numbers to facilitate association and description. For example, the first turbine blade 440*a* includes the abutment 471*a* and the upper shroud 465*a*. In a further example the turbine blade 440*b* can be referenced as the second turbine blade 440*b*. In the description, the use of a reference number without a sub-letter applies to each such element or component.

Structures and features previously described in connection with earlier described embodiments may not be repeated here with the understanding that, when appropriate, that previous description applies to the embodiment depicted in FIGS. 4 through 7. Additionally, the emphasis in the following description is on variations of previously introduced features or elements. Also, some reference numbers for previously descripted features are omitted.

In the embodiment, the upper shroud 465*a* of the first turbine blade 440*a* interlocks with the upper shroud 465*b* of the second turbine blade 440*b*. In some embodiments, a plurality of shrouded turbine blades 440 may be installed circumferentially around a turbine disk 430, wherein each shrouded turbine blade 440 may interlock with adjacent shrouded turbine blades 440 at adjacent abutments 471, 472 to form a continuous annular arrangement.

Figure 5:
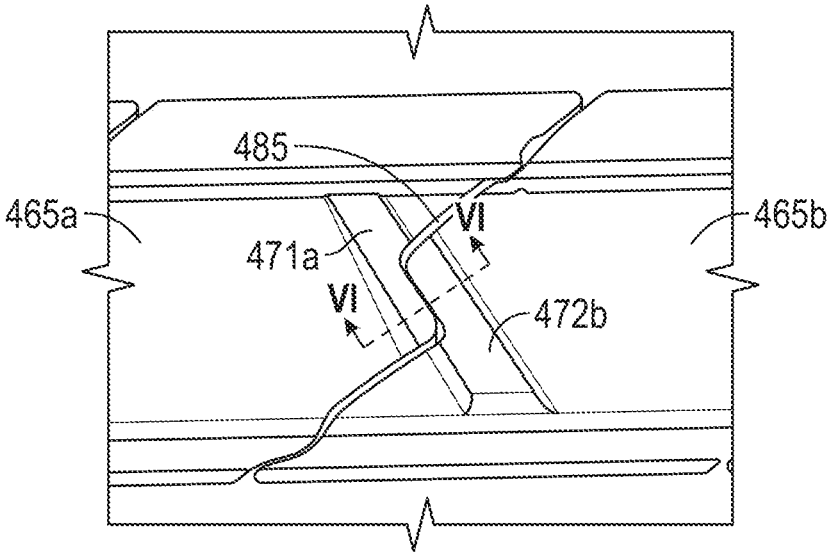
FIG. 5 is a top view of the first turbine blade and the second turbine blade of FIG. 4.

FIG. 5 is a top view of the first turbine blade and the second turbine blade of FIG. 4. In an embodiment, the upper shroud 465*a* of the first turbine blade 440*a* interlocks with the upper shroud 465*b* of the second turbine blade 440*b*. The abutment face 471*a* of the first turbine blade 440*a* may be configured to contact and align with an abutment 472*b* of the second turbine blade 440*b*. An abutment gap 485 may be formed by the space between the two abutments 471*a*, 472*b*. In an embodiment, the abutment gap 485 can have several "turns" and can have an "S" shape or a "Z" shape. In other examples the abutment gap 485 can be in straight line, have curves, or other shapes that are formed by the interface between two adjacent abutments 471*a*, 472*b*. Though an abutment gap 485 is shown in FIG. 5 for clarity, the turbine blades 400*a*, 440*b* can contact each other when assembled into the turbine disk assembly 430 and may not provide an abutment gap 485.

Figure 6:
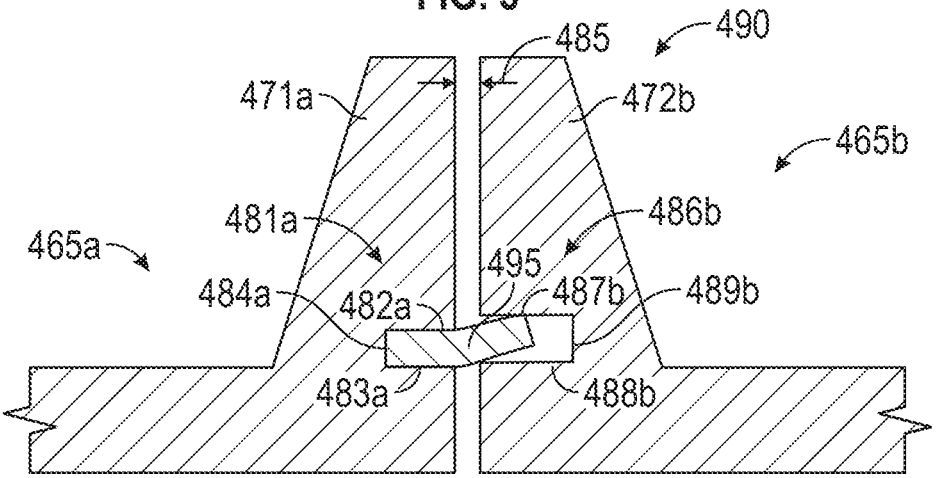

FIG. 6 is a cross sectional view of the turbine blades of FIG. 5 along line VI-VI with an exemplary damper positioned in between. The abutment 471*a* from the first turbine blade 440*a* can have a first small slot 481*a* and the abutment 472*b* from the second turbine blade 440*b* can have a second large slot 486*b* that can be sized larger than the first small slot 481*a*. Though not shown, the first turbine blade 440*a* can also have a first large slot located opposite from the first small slot 481*a* within abutment 472*a*. The first large slot can have similar or the same features as the second large slot 486*b*. Though not shown, the second turbine blade 440*b* can also have a second small slot located opposite from the second large slot 486*b*. The second small slot can have similar or the same features as the first small slot 481*a*.

The first small slot 481*a* can be partially formed by a first small slot top surface 482*a*, a first small slot bottom surface 483*a*, and a first small slot side surface 484*a*. The first small slot bottom surface 483*a* can be located opposite and inward of the first small slot top surface 482*a*. The first small slot side surface 484*a* can extend from the first small slot top surface 482*a* inward to the first small slot bottom surface 483*a*.

The second large slot can be sized slightly larger than the first small slot to facilitate the positioning of the turbine blades 440 during assembly. The second large slot 486*b* can be partially formed by a second large slot top surface 487*b*, a second large slot bottom surface 488*b*, and a second large slot side surface 489*b*. The second large slot bottom surface 488*b* can be located opposite and inward of the second large slot top surface 487*b*. The second large slot top surface 487*b* and second large slot bottom surface 488*b* and have greater dimensions than the first small slot top surface 482*a* and first small slot bottom surface 483*a* respectively. The second large slot side surface 489*b* can extend from the second large slot top surface 487*b* inward to the second large slot bottom surface 488*b*. The second large slot side surface 489*b* can radially extend further than the first small slot side surface 483*a*.

In an embodiment, the second large slot bottom surface 488*b* is slightly radially outward of the first small slot bottom surface 483*a*, creating a step between the two slot 481*a*, 486*b*. In other examples the second large slot top surface 487*b* is slightly radially inward of the first small slot top surface 482*a*, creating a step between the two slot 481*a*, 486*b*. In an embodiment, the second large slot top surface 487*b* is located radially outward of the first small slot top surface 482*a*. In other words, the second large slot top surface 487*b* can be located further from the base 442 than the first small slot top surface 482*a*.

The turbine blades 440*a*, 440*b* and a damper 495 can be part of a damped turbine blade system 490. The damper 495 can be positioned within the first small slot 481*a* and extend into the second large slot 486*b*. The damper 495 can be shaped as a rectangular strip and have a generally rectangular cross-section extending between the two abutments 471*a*, 472*b*. The damper 495 can be configured to bend and change its shape to extend from the first small slot 481*a* and transition into the second large slot 486*b*. The damper 495 can have a variety of shapes and can be shaped to conform to the shapes and positioning of the first small slot 481*a* and the second large slot 486*b*.

In an embodiment, a portion of the damper 495 simultaneously contacts the first small slot top surface 482*a* and the first small slot bottom surface 483*a*. In an embodiment the damper 495 contacts the first small slot side surface 484*a*. In an embodiment the damper 495 does not contact the second large slot side surface 489*b* while in contact with the first small slot side surface 484*a*. The damper 495 can comprise of metal such as steel. In an embodiment, a portion of the damper 495 can be configured to be fixed within the first small slot 481*a* such that the damper 495 does not move within the first small slot 481*a* during operation of the gas turbine engine 100. In an embodiment a portion of the damper 495 can be configured to slidably mate with the second large slot 486*b*.

Figure 7:
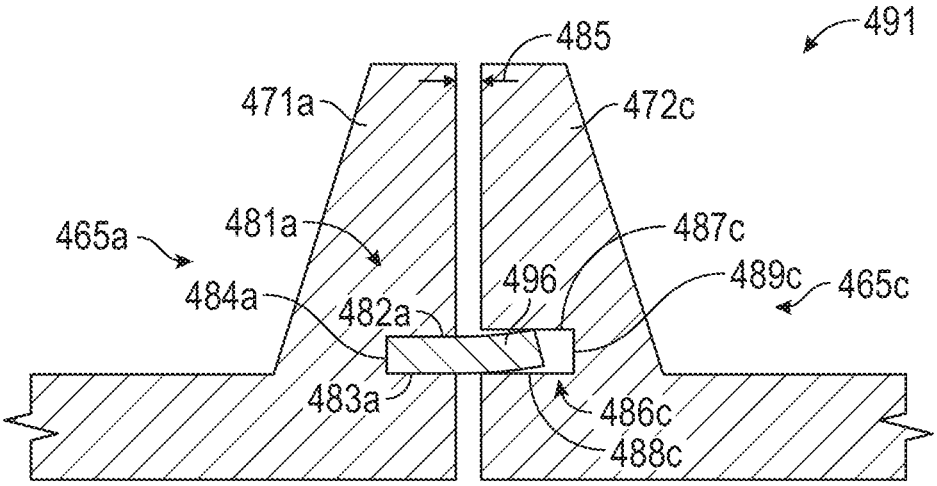
FIG. 7 is a cross sectional view of another damped turbine blade assembly, similar to FIG. 6.

FIG. 7 is a cross sectional view of another damped turbine blade assembly, similar to FIG. 6. Structures and features previously described in connection with earlier described embodiments may not be repeated here with the understanding that, when appropriate, that previous description applies to the embodiment depicted in FIG. 7. Additionally, the emphasis in the following description is on variations of previously introduced features or elements. Also, some reference numbers for previously descripted features are omitted.

In the embodiment, an upper shroud 465*c* includes an abutment 472*c*. The abutment 472*c* includes a second large slot 486*c*. The second large slot 486*c* can be partially formed by a second large slot top surface 487*c*, a second large slot bottom surface 488*c*, and a second large slot side surface 489*c*.

The first small slot bottom surface 483*a* and the second large slot bottom surface 488*c* can radially align and create an even transition over the abutment gap 485. In an example the first small slot top surface 482*a* and the second large slot top surface 487*c* can radially align and create an even transition over the abutment gap 485.

In an embodiment damped turbine blade system 491 can include a damper 496, the first small slot 481*a*, and the second large slot 486*c*. In an embodiment the damper 496 can be shaped with a radial bend, curving radially outward or inward, and can be configured to be positioned within the second large slot 486*b*.

Figure 8:
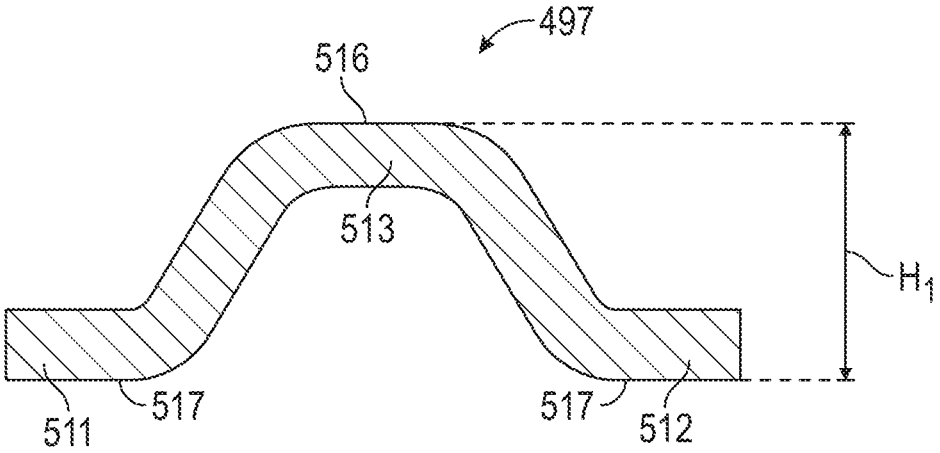
FIG. 8 is a cross sectional view of another embodiment of a damper.

FIG. 8 is a cross sectional view of another embodiment of a damper. A damper 497 can have a body portion 513, a first leg portion 511, and a second leg portion 512. A damper 497 can have a cross section taken perpendicular to its longitudinal axis, that can be shaped as a half hexagon with two leg portions 511, 512 extending in opposite directions, such as a plateau like shape. In other words, the damper 497 cross-section is shaped similar to an omega symbol with its leg portions 511, 512 stretched apart in opposite directions from each other. The second leg portion 512 can have a shape that is a mirror image of the first leg portion shape 511. The first leg portion 511, second leg portion 512, and body portion 513, can have a thickness that is substantially equal. In an embodiment the first leg portion 511 can be configured to be positioned within the first slot 481*a* and to contact the first slot bottom surface 483*a* and not the first slot top surface 482*a*.

The damper 497 can have a damper top surface 516 and a damper bottom surface 517 opposite the damper top surface 516. The damper top surface 516 can extend across the top of the first leg portion 511, the top of the body portion 513, and the top of the second leg portion 512. The damper bottom surface 517 can extend across the bottom of the first leg portion 511, the bottom of the body portion 513, and the bottom of the second leg portion 512.

The height H1 of the damper 497 can be the maximum distance between the damper top surface 516 and the damper bottom surface 517. In other words the height H1 can be the distance between the top of the body portion 513 and the bottom of the first leg portion 511 and the second leg portion 512.

Figure 9:
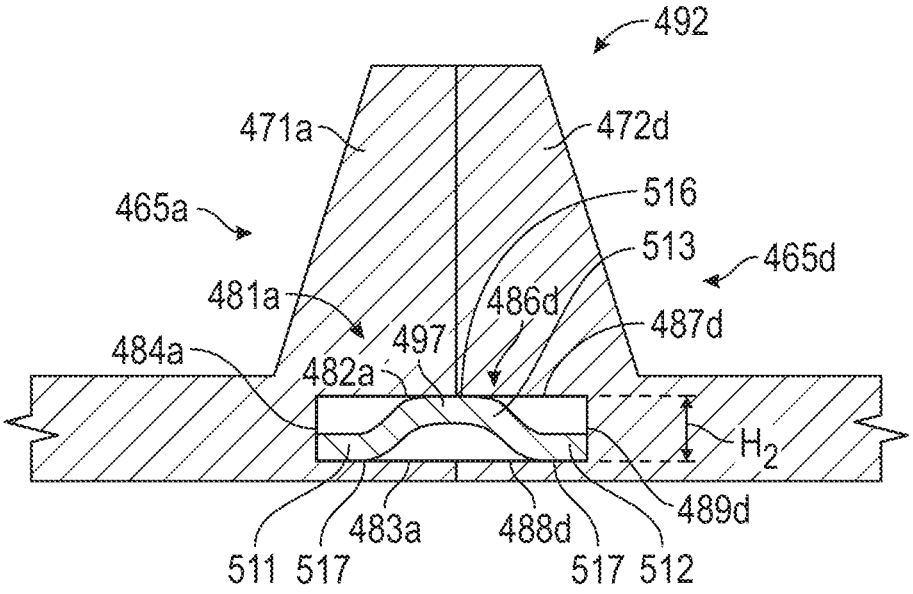
FIG. 9 is a cross sectional view of another damped turbine blade assembly, with the damper from FIG. 8.

FIG. 9 is a cross sectional view of another damped turbine blade assembly, with the damper from FIG. 8. Structures and features previously described in connection with earlier described embodiments may not be repeated here with the understanding that, when appropriate, that previous description applies to the embodiment depicted in FIG. 9. Additionally, the emphasis in the following description is on variations of previously introduced features or elements. Also, some reference numbers for previously descripted features are omitted.

In the embodiment, an upper shroud 465*d* includes an abutment 472*d*. The abutment 472*d* includes a second large slot 486*d*, also referred to as a second slot 486*d*. The second slot 486*d* can be partially formed by a second large slot top surface 487*d*, a second large slot bottom surface 488*d*, and a second large slot side surface 489*d*. The second large slot top surface 487*d*, the second large slot bottom surface 488*d*, and the second large slot side surface 489*d* can be referred to as the second slot top surface 487*d*, the second slot bottom surface 488*d*, and the second slot side surface 489*d* respectively.

In an embodiment the second slot 486*d* is the same or similarly sized as the first small slot 481*a*, also referred to as first slot 481*a*. In an embodiment the second slot top surface 487*d*, the second slot bottom surface 488*d*, and the second slot side surface 489*d*, have the same or similar dimensions and orientation as the first small slot top surface 482*a*, the first small slot bottom surface 483*a*, and the first small slot bottom surface 484*a*. The first small slot top surface 482*a*, the first small slot bottom surface 483*a*, and the first small slot bottom surface 484*a*, can be referred to as the first slot top surface 482*a*, the first slot bottom surface 483*a*, and the first small bottom surface 484*a* respectfully.

The first slot bottom surface 483*a* and the second slot bottom surface 488*d* can radially align and create an even transition. In an example the first slot top surface 482*a* and the second slot top surface 487*d* can radially align and create an even transition.

In the embodiment shown, a damped turbine blade system 492 can include the damper 497, the first small slot 481*a* (sometimes referred to as the first slot), and the second large slot 486*d*. In the embodiment shown, the damper 497 can be shaped with a bend and be compressed into the first slot 481*a* and the second slot 486*d* to provide a pre-loaded force within the two slots 481*a*, 489*d*.

In the embodiment shown the slots 481*a*, 489*d* have a height H2. In the embodiment, the height H2 of the slots 481*a*, 489*d*, can be shorter than the height H1 of the damper 497.

In an embodiment, the damper top surface 516 contacts the first slot top surface 482*a* and the second lot top surface 487*d* and the damper bottom surface 517 contacts the first slot bottom surface 483*a* and the second slot bottom surface 488*d*. In other embodiments the damper 497 is flipped and the damper bottom surface 517 contacts the first slot top surface 482*a* and the second lot top surface 487*a* and the damper top surface 516 contacts the first slot bottom surface 483*a* and the second slot bottom surface 488*d*.

In an embodiment the first leg portion 511 can be configured to be positioned within the first slot 481*a* and to contact the first slot bottom surface 483*a* without contacting the first slot top surface 482*a*. The first leg portion 511 and second leg portion 512 can be orientated substantially parallel with respect to the first slot 481*a* and second slot 486*d* respectively. In an embodiment the damper bottom surface 517, proximate the first leg portion 511, can be substantially parallel with the first slot bottom surface 483*a* and the damper top surface 516, proximate the base portion, can be substantially parallel with the second slot top surface 487*d*. In an embodiment the damper 497 can contact the first slot side surface 484*a*. In an embodiment the damper 497 can contact the second slot side surface 489*d*.

Figure 10:
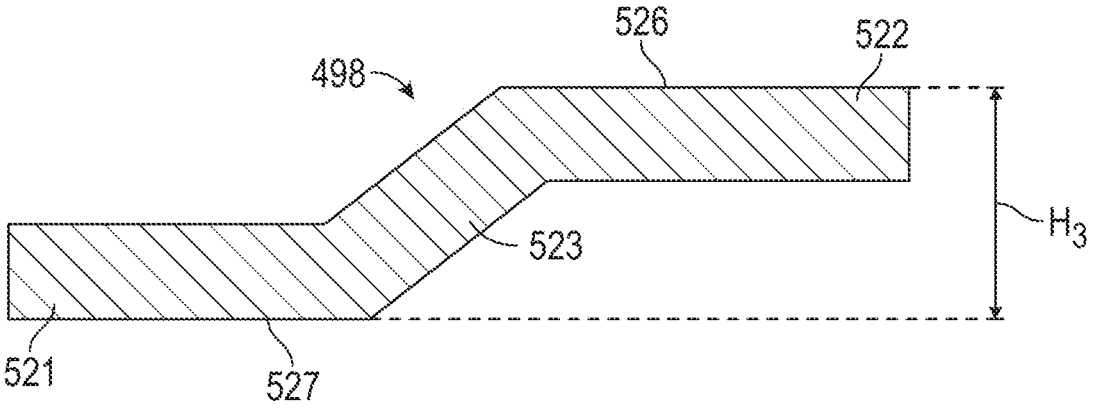
FIG. 10 is a cross sectional view of another embodiment of a damper.

FIG. 10 is a cross sectional view of another embodiment of a damper. A damper 498 can have a body portion 523, a first leg portion 521, and a second leg portion 522. A damper 498 can have a cross section taken perpendicular to its longitudinal direction that can be shaped similar to a "z" such as a z shaped cantilever. The first leg portion 521 and second leg portion 522 can be positioned sustainably parallel to each other. The body portion 523 can extend diagonally from the first leg portion 521 to the second leg portion 522. The first leg portion 521, second leg portion 522, and body portion 523, can have a thickness that is substantially equal.

The damper 498 can have a damper top surface 526 and a damper bottom surface 527 opposite the damper top surface 526. The damper top surface 526 can extend across the top of the first leg portion 521, the top of the body portion 523, and the top of the second leg portion 522. The damper bottom surface 527 can extend across the bottom of the first leg portion 521, the bottom of the body portion 523, and the bottom of the second leg portion 522.

The height H3 of the damper 498 can be the maximum distance between the damper top surface 526 and the damper bottom surface 527. In other words the height H3 can be the distance between the top of the second leg portion 522 and the bottom of the first leg portion 521.

Figure 11:
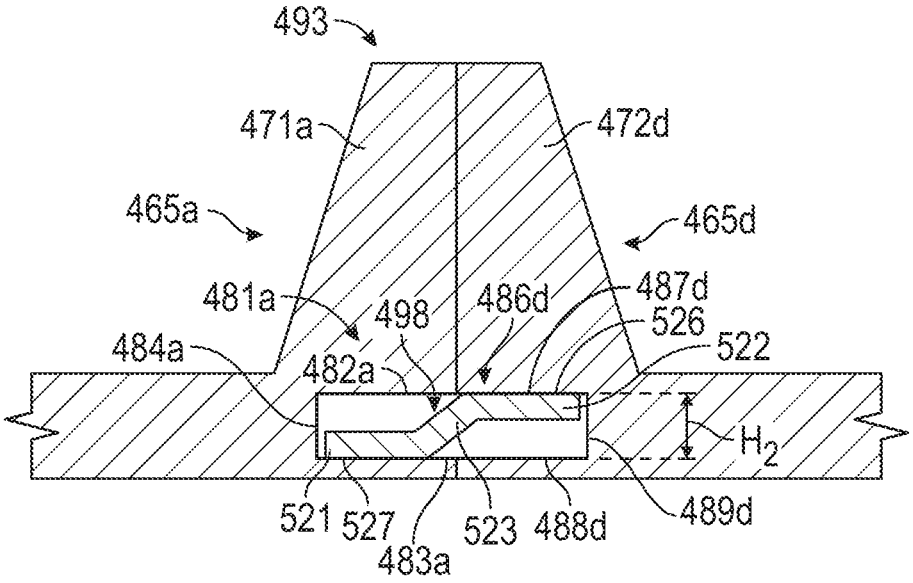
FIG. 11 is a cross sectional view of another damped turbine blade assembly, with the damper from FIG. 10.

FIG. 11 is a cross sectional view of another damped turbine blade assembly, with the damper from FIG. 10. Structures and features previously described in connection with earlier described embodiments may not be repeated here with the understanding that, when appropriate, that previous description applies to the embodiment depicted in FIG. 11.

Additionally, the emphasis in the following description is on variations of previously introduced features or elements. Also, some reference numbers for previously descripted features are omitted.

In the embodiment shown, a damped turbine blade system 493 can include the damper 498, the first small slot 481*a* (sometimes referred to as the first slot), and the second large slot 486*d*. In the embodiment shown, the damper 498 can be shaped to be compressed into the first slot 481*a* and the second slot 486*d* to provide a pre-loaded force within the two slots 481*a*, 489*d*.

In the embodiment shown the slots 481*a*, 489*d* have a height H2. In the embodiment, the height H2 of the slots 481*a*, 489*d*, can be shorter than the height H3 of the damper 498.

In an embodiment, the damper top surface 526, proximate the second leg portion 522, can contact the second lot top surface 487*d* and the damper bottom surface 527, proximate the first leg portion 521, can contact the first slot bottom surface 483*a*. In other embodiments the damper 498 is flipped and the damper top surface 526 contacts the first slot top surface 482*a* and the damper bottom surface 527 contacts the second slot bottom surface 488*d*.

In an embodiment the first leg portion 521 can be configured to be positioned within the first slot 481*a* and to contact the first slot bottom surface 483*a* without contacting the first slot top surface 482*a*. The first leg portion 521 and second leg portion 522 can be orientated substantially parallel with respect to the first slot 481*a* and second slot 486*d* respectively. In an embodiment the damper bottom surface 527, proximate the first leg portion 521, can be substantially parallel with the first slot bottom surface 483*a* and the damper top surface 526, proximate the second leg portion 522, can be substantially parallel with the second slot top surface 487*d*. In an embodiment the damper 498 can contact the first slot side surface 484*a*. In an embodiment the damper 498 can contact the second slot side surface 489*d*.

INDUSTRIAL APPLICABILITY

The present disclosure generally applies to a damped turbine blade assembly 490, 491, 492, 493 for gas turbine engines 100. The described embodiments are not limited to use in conjunction with a particular type of gas turbine engine 100, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed damped turbine blade assembly 490, 491, 492, 493 are applicable to the use, assembly, manufacture, operation, maintenance, repair, and improvement of gas turbine engines 100, and may be used in order to improve performance and efficiency, decrease maintenance and repair, and/or lower costs. In addition, embodiments of the presently disclosed damped turbine blade assembly 490, 491, 492, 493 may be applicable at any stage of the gas turbine engine's 100 life, from design to prototyping and first manufacture, and onward to end of life. Accordingly, the damped turbine blade assembly 490, 491, 492, 493 may be used in a first product, as a retrofit or enhancement to existing gas turbine engine, as a preventative measure, or even in response to an event. This is particularly true as the presently disclosed turbine blades 440*a*, 440*b* of the damped turbine blade assembly 490 may conveniently include identical interfaces to be interchangeable with an earlier type of turbine blades.

As discussed above, the turbine blades 440*a*, 440*b* may be cast formed. According to one embodiment, the turbine blades 440*a*, 440*b* may be made from an investment casting process. For example, the entire turbine blades 440*a*, 440*b* may be cast from stainless steel and/or a superalloy using a ceramic core or fugitive pattern. Notably, while the structures/features have been described above as discrete members for clarity, as a single casting, the structures/features may be integrated with the skin 460. Alternately, certain structures/features may be added to a cast core, forming a composite structure.

In the disclosed embodiment, the turbine blades 440*a*, 440*b* have several natural frequencies and modal responses that are generally static (dormant/un-excited) as the speed of the associated gas turbine engine 100 increases. These modal responses include a first torsional modal response, a first flexural modal response, and a first bending response, which can be the strongest of the modal responses. Turbine blades 440*a*, 440*b* can also have second, third, and further consecutive modal responses, however these are typically not strong enough to be considered to be mitigated for. If the first modal responses occur within the operating speed (typically reported in rotations per minute, RPM) range of the gas turbine engine 100, high cycle fatigue and blade failures are more likely to occur. The operating speed range is the range of speeds the gas turbine engine 100 is designed to operate at for long periods of time. Therefore it would beneficial to keep these natural frequencies and modal responses from occurring within the operating speed range of the gas turbine engine 100. The operating speed range can be 80% to 100% of the maximum RPM capacity of the gas turbine engine 100.

In the embodiments disclosed, the turbine blades 440*a*, 440*b* can be located at the $3^{rd}$ or $4^{th}$ stage of the turbine 400, or can be any turbine blades having an upper shroud 465 located at a stage within the turbine 400.

In an embodiment, a damper 495, 496, 497, 498 is positioned between an abutment 471*a* of a first turbine blade 440*a* and an abutment 472*b*, 472*c*, 472*d* of a second turbine blade 440*b* and forms a damped turbine blade assembly 490, 491, 492, 493. The use of the damper 495, 496, 497, 498 can help increase and maintain rotational stiffness, provide damping of vibrations through Coulomb friction, and can maintain resonate modes out of interference. The damper 495, 496, 497, 498 can be shaped to provide a pre-load when positioned within the first small slot 481*a* and the second large slot 486*b,c,d*. The pre-loaded damper 495, 496, 497, 498 provides its own force component for Coulomb friction damping and doesn't not require forces generated by the high speed rotation of the turbine disk assembly 420.

In an embodiment, a portion of the damper 495, 496 is configured to be press-fitted into the first small slot 481*a* and can remain in this fixed position with respect to the first turbine blade 440*a* during operation of the gas turbine engine 100. By fitting the damper 495, 496 within the first small slot 481*a* and fixing the damper's 495, 496 position in place with the abutment 471*a*, the relative displacement can be yielded between the two turbine blades 440*a*, 440*b* and the damper 495, 496. With the damper 495, 496 in the fixed configuration, the damped turbine assembly 490, 491 can operate without damaging resonance independently of the RPM of the gas turbine engine 100. The damper 495, 496 in the fixed configuration cannot move during operation and can be preloaded during assembly of the turbine blades into the turbine rotary disks 430. The damper 495, 496 in the fixed configuration can increase the ability to control the magnitude of pre-stress loaded into the damper 495,496.

The damper 495, 496, 497, 498 can be configured to be positioned within the second large slot 486*b,c,d* and make contact with at least one of the second large slot top surface 487*b,c,d* and the second large slot bottom surface 488*b,c,d* of the second large slot 486*b,c,d* to provide damping through friction and the movement of the turbine blades 440*a*, 440*b* during operation of the gas turbine engine. The strength of the damping relies on the applied force from the damper 495, 496, 497, 498 to the at least one of the second large slot top surface 487*b,c,d* and the second large slot bottom surface 488*b,c,d* as well as the coefficient of friction between the damper 495, 496, 497, 498 and the at least one of the second large slot top surface 487*b,c,d* and the second large slot bottom surface 488*b,c,d*. The damper 495, 496, 497, 498 can be shaped and/or pre-stressed to control the normal force component of the friction between the damper 495, 496, 497, 498 and the second large slot 486*b,c,d*.

The force between the damper 495 and the second large slot 486*b* can be provided by an offset geometry of the first small slot 481*a* and the second large slot 486*b*. In FIG. 6, the damper 495 has a flat rectangular profile, and is preloaded during assembly of the turbine blades 440*a*, 440*b*, into turbine disk 430, due to the difference in radial and geometry alignment of the first small slot 481*a* and second large slot 486*b*. This difference in alignment forces the damper 495 to bend and change shape in order to fit within the second large slot 486*b*. This bending and shape conforming induces a force between the damper 495 and the second large slot 486*b* and that force becomes a component of the friction damping as the turbine blades 440*a*, 440*b* move tangentially in respect to the radial direction during operation of the gas turbine engine 100.

In FIG. 7, the first small slot 481*a* and the second large slot 486*c* radially align and the damper 496 has a curved geometry or has a bend. The damper 496 can be milled to have a bend to its shaped or be pre-stressed and bent into position. The non-flat shape of the damper 496 can be positioned into the second large slot 486*c* and may deform, bend, or conform and induce a force between the damper 496 and the second large slot 486*c*.

Referring to FIG. 9, the placement of the damper 497 within the smaller height H2 of the first slot 481*a* and second slot 486*d* requires the damper 497 to compress and provide reaction forces based on the shape and the stiffness of the damper 497 to the first slot top surface 482*a*, first slot bottom surface 483*a*, second slot top surface 487*d*, and second slot bottom surface 488*d* simultaneously. The damper 497 can be shaped differently and made of varying materials to provide the necessary stiffness and pre-load needed to provide the desired friction damping effect.

Referring to FIG. 11, the placement of the damper 498 within the smaller height H2 of the first slot 481*a* and second slot 486*d* requires the damper 498 to compress and provide reaction forces based on the shape and the stiffness of the damper 498 to the first slot bottom and second slot top surface 487*d* simultaneously. The damper 498 can be shaped differently and made of varying materials to provide the necessary stiffness and pre-load needed to provide the desired friction damping effect.

Referring to FIGS. 6, 7, 9, and 11 the damper 495, 496, 497, 498 and the second large slot 486*b,c,d* can be sized to provide movement between the damper 495, 496, 497, 498 and second large slot 486*b,c,d* in a direction generally tangent to the radial direction 96 and generally perpendicular to the center axis 95.

The damper 495, 496, 497, 498 and the second large slot 486*b,c,d* can be sized to restrict movement between the damper 495, 496, 497, 498 and second large slot 486*b,c,d* in the radial direction and may increase the radial stiffness of the first turbine blade 440*a* and second turbine blade 440*b*. In other words, the first turbine blade 440*a* and the second turbine blade 440*b* will have the same radial displacement during operation of the gas turbine engine due to the damper 495, 496, 497, 498 extending between them. In an embodiment, the damper 495, 496, 497, 498 is configured to simultaneously contact both the second large slot top surface 487*b,c,d* and the second large bottom surface 488*b,c,d* and does not move radially with respect to the second large slot 486*b,c,d* during operation of the gas turbine engine 100.

The damper 495, 496, 497, 498 and the second large slot 486*b,c,d* can be sized to reduce and prevent angular movement between the first turbine blade 440*a* and the second turbine blade 440*b* and increase the angular stiffness of the first turbine blade 440*a* and the second turbine blade 440*b*. Without the damper 495, 496, 497, 498 the first blade 440*a* can bend towards the aft end of the gas turbine engine 100 during operation and the second blade 440*b* can bend towards the forward end of the gas turbine engine 100 during operation. With the damper 495, 496, 497, 498 positioned within the first small slot 481*a* and the second large slot 486*b,c,d* and by the damper 495, 496, 497, 498, the first turbine blade 440*a* and the second turbine blade 440*b* are able to stay connected and have similar angular movement during operation of the gas turbine engine 100 and have increased angular stiffness with respect to not having the damper 495, 496, 497, 498. The damped turbine blade assembly 490, 491, 492, 493 includes inter-blade radial locking of the first turbine blade 440*a* and the second turbine blade 440*b* such that during operation of the gas turbine engine 100, their angular movement is in the same direction and maintains the operating angular frequency to be above the resonant angular frequency. In other words, the damper 495, 496, 497, 498 can be configured and positioned to reduce relative radial and angular movement of the first turbine blade 440*a* in respect to the second turbine blade 440*b* during operation of the gas turbine engine 100.

Although this invention has been shown and described with respect to detailed embodiments thereof, it will be understood by those skilled in the art that various changes in form and detail thereof may be made without departing from the spirit and scope of the claimed invention. For example, the slots 481*a*, 489*b,c,d* can be tilted with respect to the rotor axis to facilitate assembly and/or to extend the slot cross-section length. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

What is claimed is:

1. A damped turbine blade assembly for use in a gas turbine engine, the damped turbine blade assembly comprising:

a first turbine blade including
- a base,
- an airfoil comprising
  - a skin extending from the base, and
- an upper shroud located opposite from the base and including
  - a first small slot positioned on the upper shroud and having
    - a first small slot top surface,
  - a first small slot bottom surface located opposite of the first small slot top surface, and
  - a first small slot side surface extending from the first small slot top surface to the first small slot bottom surface;
  - a first large slot positioned on the upper shroud opposite the first small slot, the first large slot is sized larger than the first small slot, and a damper configured to be positioned within the first small slot and simultaneously contact the first small slot top surface, the first small slot bottom surface, and the first small slot side surface.

2. The damped turbine blade assembly of claim 1, wherein the damper is fixed in the first small slot by press-fitting the damper into the first small slot.

3. The damped turbine blade assembly of claim 1, further comprising a second turbine blade including a base;

an airfoil including
- a skin extending from the base; and an upper shroud extending from the airfoil opposite from the base and including
- a second large slot sized larger than the first small slot, the second large slot having
  - a second large slot top surface,
  - a second large slot bottom surface located opposite of the second large slot top surface,
  - a second large slot side surface extending from the second large slot top surface to the second large slot bottom surface, and
  - wherein the first small slot of the first turbine blade is positioned adjacent and aligned with the second large slot of the second turbine blade.

4. The damped turbine blade assembly of claim 3, wherein the second large slot top surface is located further from the base than the first small slot top surface.

5. The damped turbine blade assembly of claim 3, wherein the damper is configured to remain in a fixed position within the first small slot during the operation of the gas turbine engine.

6. The damped turbine blade assembly of claim 3, wherein the damper is configured to mitigate radial and angular movement between the first turbine blade and second turbine blade during operation of the gas turbine engine.

7. The damped turbine blade assembly of claim 3, wherein the damper is configured to reduce the vibration of the first turbine blade and second turbine blade through friction damping from the damper sliding along the second large slot bottom surface and second large slot top surface.

8. The damped turbine blade assembly of claim 3, wherein the damper is shaped to provide a preloaded force when positioned within the second large slot.

9. A turbine blade for use in a gas turbine engine, the turbine blade comprising:

a base;

an airfoil comprising
- a skin extending from the base; and an upper shroud located opposite from the base and including
- a first abutment including a first small slot having
  - a first small slot top surface,
  - a first small slot bottom surface located opposite of the first small slot top surface, and
  - a first small slot side surface extending from the first small slot top surface to the first small slot bottom surface, and
- a second abutment positioned opposite from the first abutment including a first large slot sized larger than the first small slot, the first large slot having a first large slot top surface,
  - a first large slot bottom surface located opposite and of the first large slot top surface, and
  - a first large slot side surface extending from the first large slot top surface to the first large slot bottom surface.

10. The turbine blade of claim 9, wherein the first small slot and the first large slot have a rectangular shape.

11. The turbine blade of claim 9, wherein the first large slot top surface is located further from the base than the first small slot top surface.

12. The turbine blade of claim 9, wherein the first small slot top surface, the first small slot bottom surface, and the first small slot side surface are configured to contact a damper simultaneously.

13. The turbine blade of claim 9, wherein the first small slot is configured to receive a damper by press fitting.

14. A damped turbine blade assembly for use in a gas turbine engine, the damped turbine blade assembly comprising:

a first turbine blade including
- a base,
- an airfoil comprising
  - a skin extending from the base, and
- an upper shroud located radially outward from the airfoil and having
  - a first slot having
    - a first slot top surface, and
    - a first slot bottom surface located opposite of the first slot top surface, a second turbine blade including
- a base,
- an airfoil including
  - a skin extending from the base, and an upper shroud located radially outward from the airfoil and having
- a second slot; and a damper configured to be positioned within the first slot and the second slot having
- a body portion, a first leg portion extending from the body portion, the first leg portion configured to be positioned within the first slot and contact the first slot bottom surface without contacting the first slot top surface, and a second leg portion extending from the body portion opposite from the first leg portion, the second leg portion configured to be positioned with in the second slot.

15. The damped turbine blade assembly of claim 14, wherein the damper is configured to reduce relative radial and angular movement of the first turbine blade in respect to the second turbine blade during operation of the gas turbine engine.

16. The damped turbine blade assembly of claim 14, wherein the damper is configured to dampen the vibration of the first turbine blade and second turbine blade through friction damping from the damper sliding along at least one of the second slot bottom surface and the second slot top surface in at least one of a tangential and a rotational direction.

17. The damped turbine blade assembly of claim 14, wherein the damper is shaped to provide a preloaded force when positioned within the first slot and second slot.

18. The damped turbine blade assembly of claim 14, wherein the first leg portion, body portion, and second leg portion have substantially equal thickness.

19. The damped turbine blade assembly of claim 14, wherein the first leg portion and second leg portion are orientated substantially parallel with respect to the first slot and second slot respectively.

20. The damped turbine blade assembly of claim 14, wherein the damper has a greater height than a height of the first slot and a height of the second slot.

* * * * *